US007077205B2

(12) United States Patent
Eddison

(10) Patent No.: US 7,077,205 B2
(45) Date of Patent: Jul. 18, 2006

(54) METHOD AND DEVICE TO FREE STUCK OBJECTS

(75) Inventor: Alan Martyn Eddison, Stonehave (GB)

(73) Assignee: Andergauge Limited, Aberdeen (GB)

( * ) Notice: Subject to any disclaimer, the term of this patent is extended or adjusted under 35 U.S.C. 154(b) by 0 days.

(21) Appl. No.: 10/363,587

(22) PCT Filed: Sep. 4, 2001

(86) PCT No.: PCT/GB01/03968

§ 371 (c)(1),
(2), (4) Date: May 13, 2003

(87) PCT Pub. No.: WO02/20940

PCT Pub. Date: Mar. 14, 2002

(65) Prior Publication Data

US 2004/0011564 A1 Jan. 22, 2004

(30) Foreign Application Priority Data

Sep. 5, 2000 (GB) ..... 0021743.0

(51) Int. Cl.
*E21B 31/12* (2006.01)

(52) U.S. Cl. ..... 166/301; 166/98; 166/99; 166/178; 166/320; 166/386

(58) Field of Classification Search ..... 166/301, 166/98, 99, 178, 383, 386, 320, 321, 120
See application file for complete search history.

(56) References Cited

U.S. PATENT DOCUMENTS

| | | | | |
|---|---|---|---|---|
| 3,735,827 | A * | 5/1973 | Berryman | 175/296 |
| 4,890,682 | A | 1/1990 | Worrall et al. | |
| 5,228,507 | A * | 7/1993 | Obrejanu et al. | 166/98 |
| 5,473,939 | A * | 12/1995 | Leder et al. | 73/152.12 |
| 6,497,281 | B1 * | 12/2002 | Vann | 166/250.15 |

FOREIGN PATENT DOCUMENTS

| | | |
|---|---|---|
| GB | 1 250 077 | 10/1971 |
| GB | 2 256 218 A | 12/1992 |
| GB | 2 289 910 A | 12/1995 |
| GB | 2 329 408 A | 3/1999 |
| WO | WO 84/00577 A1 | 2/1984 |
| WO | WO 97/44565 A1 | 11/1997 |
| WO | WO 97/45622 A1 | 12/1997 |
| WO | WO 97/46787 A1 | 12/1997 |

* cited by examiner

*Primary Examiner*—Zakiya W. Bates
(74) *Attorney, Agent, or Firm*—Alston & Bird LLP

(57) ABSTRACT

A method of freeing stuck objects (16) from a bore (14) comprises running a string (12) into the bore (14), the string (12) including a flow modifier, such as a valve, for producing variations in the flow of fluid through the string, and a device for location in the string and adapted to axially extend or contract in response to variations in the flow of fluid through the string. A portion of the string (12) engages the stuck object (16). Fluid is then passed through the string while applying tension to the string, whereby the tension applied to the stuck object varies in response to the operation of the flow modifier and the extending or retracting device.

13 Claims, 3 Drawing Sheets

METHOD AND DEVICE TO FREE STUCK OBJECTS

BACKGROUND OF THE INVENTION

Field of the Invention

The present invention relates to a downhole method, and to an apparatus for implementing the method.

In downhole operations, such as are involved in the oil and gas exploration and production industry, objects and tools may become stuck or jammed in the well bore. This problem is particularly prevalent in well bores which include curves or bends, or have inclined or horizontal sections. In some cases, it is possible to mill out the stuck object. However, this will often be impractical, due to the dimensions or construction of the stuck object, and also results in the destruction of the object. Accordingly, it is preferred to first attempt to dislodge the stuck object by other means. This is typically achieved by engaging the stuck object with a suitable fishing tool, and then applying an impulse force by means of a jar, or by vibrating the stuck object.

It is among the objectives of embodiments of the present invention to provide an alternative method and apparatus for releasing and retrieving stuck objects from a bore.

According to a first aspect of the present invention there is provided a method of freeing stuck objects from a bore, the method comprising:

running a string into a bore, the string including a flow modifier for producing variations in the flow of fluid through the string, and extension and retraction means for location in the string and adapted to axially extend or contract in response to variations in the flow of fluid through the string;

engaging a stuck object with a part of the string;

passing fluid through the string; and applying tension to the string, whereby the tension applied to the stuck object varies in response to the operation of the flow modifier and the retraction means.

According to another aspect of the present invention there is provided apparatus for use in freeing stuck objects in a bore, the apparatus comprising:

a tubular member for mounting on a support string, the member comprising a flow modifier for producing variations in the flow of fluid therethrough and extension and retraction means adapted to axially extend or contract in response to variations in the flow of fluid through the string; and means for engaging a stuck object.

Thus, in use, the present invention allows a varying tension or pulling force to be applied to a stuck object. It is considered that in many cases such a pulling force will be more effective in releasing a stuck object than vibrating a tensioned string or applying jars or sudden impulse forces.

The flow modifier may comprise an oscillating or rotating member, and is preferably in the form of a rotating valve, such as described in WO97\44565, the disclosure of which is incorporated herein by reference, although other valve forms may be utilised. The rotating valve may be driven by an appropriate downhole motor powered by any appropriate means, or a turbine, and most preferably by a fluid driven positive displacement motor (PDM).

The extension and retraction means preferably comprises a housing forming part of a string and containing a fluid flow or pressure actuated member and an oppositely acting biassing arrangement, fluid pressure or flow tending to actuate the member in one direction and the biassing arrangement acting in the opposite direction. Conveniently, the member is a piston and the biassing arrangement a spring; in the preferred arrangement an increase in pressure tends to move the piston in one direction, extending the housing, a decrease in fluid pressure allowing the spring to retract the housing. Those of skill in that art may recognise that these features may be found in downhole shock tools or shock absorbers, as normally used for reducing shock and vibration-induced drilling string damage and bit wear.

The flow modifier may be located above or below the engaging means, one advantage in locating the flow modifier below the engaging means being that the flow modifier is then not subject to tension during the freeing operation; this of course requires that the flow modifier be accommodated within the stuck object, which is the case if the apparatus is being used to free a length of stuck pipe.

The engaging means may take any appropriate form, depending on the nature of the object to be freed, and will typically include gripping teeth, slips, fishing heads or other profiles suitable to engage upper parts of the object to be freed.

These and other aspects of the present invention will now be described, by way of example only, with reference to the accompanying drawings, in which.

Figure 1:
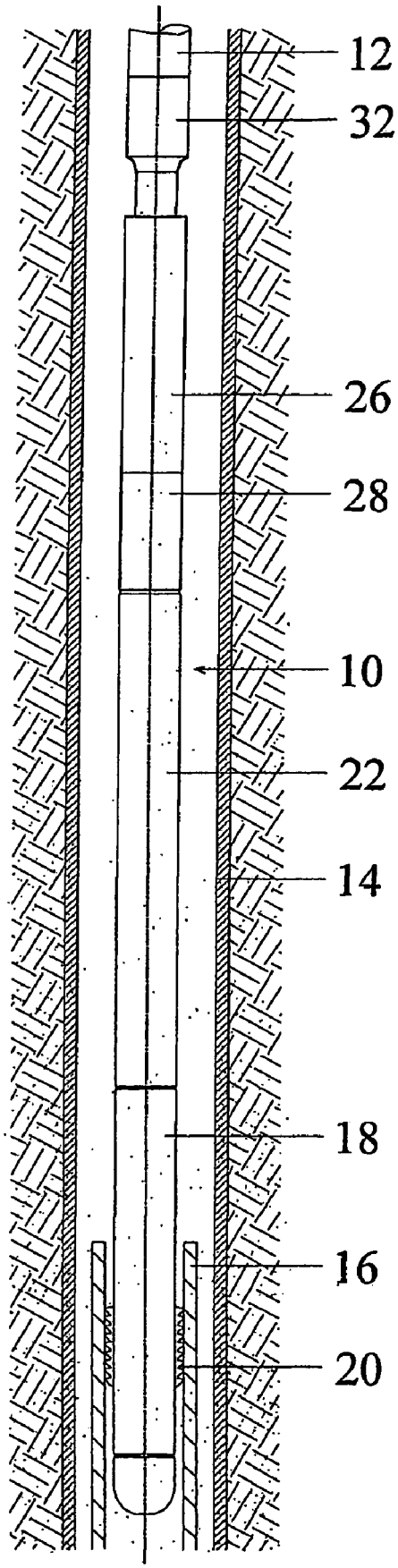
FIG. 1 is a schematic view of apparatus for use in freeing stuck objects from bores in accordance with a first aspect of the present invention.

Reference is first made to FIG. 1 of the drawings, which illustrates apparatus 10 for use in freeing stuck objects from bores in accordance with a first aspect of the present invention. The apparatus is elongate and generally tubular to allow passage of fluid therethrough, and is adapted to be mounted in the lower end of a drill pipe string 12. The apparatus 10 is illustrated located in a cased borehole 14, and is shown being utilised to free a length of pipe 16 that has become stuck fast in the borehole.

The lower end of the apparatus 10 comprises a gripping means in the form of a fishing tool 18 including toothed slips 20 which engage the inner face of the pipe 16.

Above the fishing tool 18 is a body 22 containing a positive displacement motor (PDM) and a rotating valve, such as described in U.S. Pat. No. 6,279,670, the disclosure of which is incorporated herein by reference. The valve includes a valve member which is rotated or oscillated about a longitudinal axis by the PDM and in doing so various the flow area of the valve.

Figure 2:
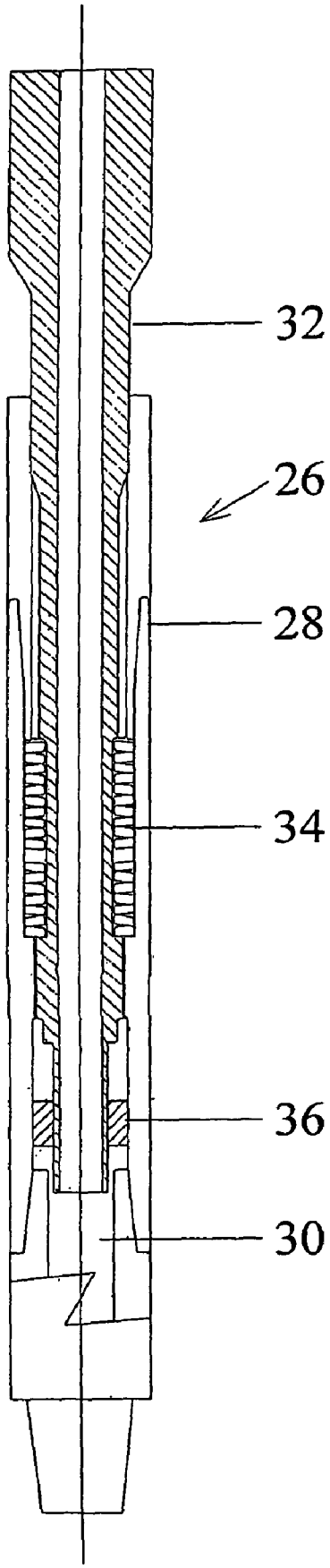
FIG. 2 is a schematic sectional view of a shock tool of the apparatus of FIG. 1.

Above the PDM and valve is a shock sub 26, as is illustrated in greater detail in FIG. 2, comprising a body 28 defining a cylinder 30 and which is mounted to the body 22, and a piston member 32 which is mounted to the string 12. The piston member 32 is coupled to the body 28 via a spring 34 which limits the degree of relative axial movement between the member 32 and the body 28. The lower end of the piston member 32 extends into the cylinder 30 and carries a floating piston 36. The volume above the piston 36 accommodates oil which serves to lubricate the spring 34 and the movement of the piston member 32 relative to the body 28, and any changes in oil volume due to temperature variations are accommodated by movement of the piston 36. A higher fluid pressure within the sub 26, as would occur when the rotating valve was restricting the flow of fluid below the sub, tends to urge the piston member 32 out of the upper end of the body 28, and thus the sub 26 to extend, while a lower pressure allows the spring to retract the sub 26 to a median configuration.

In use, the apparatus 10 is run into a bore and engages the stuck pipe 16 as shown. Tension is then applied to the string 12 and fluid pumped down through the string, driving the PDM, which rotates the valve, and causes the sub 26 to axially expand and retract; as the sub extends, the tension force applied to the stuck object will tend to decrease. Thus, this rapidly varies the tension force applied to stuck pipe 16, typically at 15 to 20 Hertz, and testing has demonstrated that such a varying tension force is effective in releasing stuck objects, such as the pipe 16.

Figure 3:
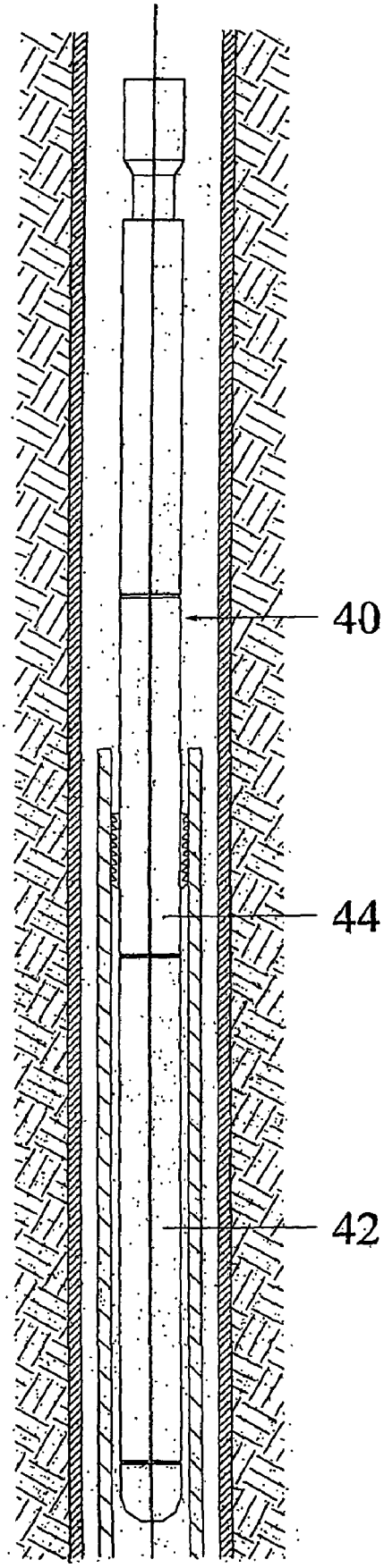
FIG. 3 is a schematic view of apparatus for use in freeing stuck objects from bores in accordance with a second aspect of the present invention.

Reference is now made to FIG. 3 of the drawings, which illustrates apparatus 40 for use in freeing stuck objects from bores in accordance with a second aspect of the present invention. The apparatus 40 is generally similar to the apparatus 10 described above, however in this second embodiment the body 42 containing the valve and PDM is located below the fishing tool 44. This offers the advantage that the body 42 is not subject to tension while the apparatus is in use, and will not experience the same variation in forces applied thereto, such that the motor and valve may be less robust if desired, without loss of reliability.

It will be apparent to those of skill in the art that the above described embodiments are merely exemplary of the present invention and that various modifications and improvements may be made thereto without departing from the scope of the invention; for example, the extension and contraction of the string may be achieved by other arrangements.

The invention claimed is:

1. A method of freeing stuck objects from a bore, the method comprising:

running a string into a bore, the string including a flow modifier for producing cyclic variations in the flow of fluid through the string, and extension and retraction means for location in the string and adapted to axially extend or contract in response to said cyclic variations in the flow of fluid through the string;

engaging a stuck object with a portion of the string;

passing fluid through the string; and applying tension to the string, whereby the tension applied to the stuck object varies cyclically in response to the operation of the flow modifier and the retraction means.

2. Apparatus for use in freeing stuck objects in a bore, the apparatus comprising:

a tubular member for mounting on a support string, the member comprising a flow modifier for producing cyclic variations in the flow of fluid therethrough and extension and retraction means adapted to axially extend or contract in response to said cyclic variations in the flow of fluid through the string; and means for engaging a stuck object.

3. The apparatus of claim 2, wherein the flow modifier comprises a rotating member.

4. The apparatus of claim 3, wherein the flow modifier comprises a rotating valve.

5. The apparatus of claim 3, further comprising a downhole motor for driving the rotating member.

6. The apparatus of claim 5, wherein the downhole motor is a positive displacement motor (PDM).

7. The apparatus of claim 2, wherein the extension and retraction means comprises a housing forming part of a string and containing a fluid actuated member and an oppositely acting biassing arrangement, fluid force tending to actuate the member in one direction and the is biassing arrangement acting in the opposite direction.

8. The apparatus of claim 7, wherein said fluid actuated member comprises a piston and the biassing arrangement a spring.

9. The apparatus of claim 8, wherein the extension and retraction means is arranged such that an increase in pressure tends to move the piston member in one direction, extending the housing, and a decrease in fluid pressure allows the spring to retract the housing.

10. The apparatus of claim 2, wherein the flow modifier is located above the engaging means.

11. The apparatus of claim 2, wherein the flow modifier is located below the engaging means.

12. The apparatus of claim 2, wherein the engaging means comprises slips.

13. A method of freeing stuck objects from a bore, the method comprising: running a string into a bore and engaging a stuck object; and applying a cyclically varying tension to the string.

* * * * *